US011453932B2

(12) United States Patent
Li et al.

(10) Patent No.: US 11,453,932 B2
(45) Date of Patent: Sep. 27, 2022

(54) THIN GAUGE WEAR-RESISTANT STEEL SHEET AND METHOD OF MANUFACTURING THE SAME

(71) Applicant: South China University of Technology, Guangzhou (CN)

(72) Inventors: Liejun Li, Guangzhou (CN); Feng Zhou, Guangzhou (CN); Jixiang Gao, Guangzhou (CN); Zhengwu Peng, Guangzhou (CN); Haibo Sun, Guangzhou (CN); Jietao Dai, Guangzhou (CN); Yanjun Lu, Guangzhou (CN)

(73) Assignee: South China University of Technology, Guangzhou (CN)

( * ) Notice: Subject to any disclaimer, the term of this patent is extended or adjusted under 35 U.S.C. 154(b) by 284 days.

(21) Appl. No.: 16/481,055

(22) PCT Filed: Mar. 31, 2017

(86) PCT No.: PCT/CN2017/078952
§ 371 (c)(1),
(2) Date: Jul. 25, 2019

(87) PCT Pub. No.: WO2018/176364
PCT Pub. Date: Oct. 4, 2018

(65) Prior Publication Data

US 2020/0024707 A1 Jan. 23, 2020

(51) Int. Cl.

| | |
|---|---|
| ***C22C 38/04*** | (2006.01) |
| ***C21D 1/18*** | (2006.01) |
| ***C21D 8/02*** | (2006.01) |
| ***C21D 9/00*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |

(52) U.S. Cl.
CPC ..... *C22C 38/04* (2013.01); *C21D 1/18* (2013.01); *C21D 8/0226* (2013.01); *C21D 9/0075* (2013.01); *C22C 38/12* (2013.01); *C22C 38/14* (2013.01); *C22C 38/16* (2013.01); *C22C 38/32* (2013.01)

(58) Field of Classification Search
None
See application file for complete search history.

(56) References Cited

FOREIGN PATENT DOCUMENTS

| | | | | | |
|---|---|---|---|---|---|
| CN | 1101211 | A | | 4/1995 | |
| CN | 102161139 | A | * | 8/2011 | |
| CN | 106191673 | A | * | 12/2016 | ..... C21C 7/10 |
| CN | 106191673 | A | | 12/2016 | |
| KR | 101571949 | B1 | | 11/2015 | |

* cited by examiner

*Primary Examiner* — Anthony J Zimmer
*Assistant Examiner* — Jacob J Gusewelle
(74) *Attorney, Agent, or Firm* — Robert L. Stearns; Dickinson Wright, PLLC

(57) ABSTRACT

A thin gauge wear-resistant steel sheet, including the following chemical elements expressed in percentage by weight: 0.15-0.20 wt. % of carbon; 1.2-1.8 wt. % of manganese; 0.1-0.40 wt. % of copper; 0.15-0.30 wt. % of molybdenum; 0.20-0.40 wt. % of chromium; 0.03-0.06 wt. % of niobium; 0.01-0.03 wt. % of titanium; 0.0006-0.0015 wt. % boron; less than 0.015 wt. % of phosphorus; less than 0.010 wt. % of sulphur; and the balance being ferrum and unavoidable impurities, wherein the thickness of the steel sheet is in a range of 3.0 to 8 mm.

7 Claims, No Drawings

THIN GAUGE WEAR-RESISTANT STEEL SHEET AND METHOD OF MANUFACTURING THE SAME

CROSS-REFERENCE TO RELATED APPLICATION

This application is a 35 U.S.C. § 371 national stage application of PCT Application Serial No. PCT/CN2017/078952 filed on Mar. 31, 2017 the entire disclosure of which are considered as part of the disclosure of this application and are hereby incorporated by reference.

TECHNICAL FIELD

The present application relates to the technical field of manufacturing a wear-resistant steel sheet, and more particularly to a thin gauge wear-resistant steel sheet and a method of manufacturing the same.

BACKGROUND TECHNOLOGY

Anti-wear and heat-resistant steel parts are widely used in high temperature oxidizing atmosphere and abrasive wear conditions. The performance of these parts directly affects the normal operation of the whole equipment, not only are high temperature strength and certain wear resistance required, but also a good oxidation resistance is needed to meet its performance requirements. The use of parts with good performance and long service can greatly decrease material consumption and reduce production cost, which has good economic benefits and can ensure safe production, and improve equipment operation efficiency, reduce equipment maintenance workload, reduce labor intensity and improve workers' labor conditions, and has good social benefits. Such parts are widely used in the following industries:

(1) Mining machinery: various crusher components such as cover plates, wear-resistant plates, etc., vibrating screens, mine truck/truck lining plates, hopper linings and feed trough linings, etc.

(2) Power industry: wind turbine blades, coal mill components, ash discharging pipes, air handling systems and transport aircraft etc.

(3) Cement industry: mill lining, sheath, impact plate, pipeline, pump casing, crusher parts, powder separator blades, various tank linings, various chassis, vibrating screen, etc.

(4) Coal processing industry: vertical mill liner, feed trough, hopper, crusher parts and liner, coal pipeline, pump body, etc.

(5) Others: hoppers, buckets, etc. in the metallurgical industry; loaders, scraper conveyors, etc. in the port machinery; excavators, bulldozer buckets and blade, dump trucks, asphalt mixers, mud pipes, washing sand machines, flotation machine, etc. in the construction industry.

At present, the main manufacturers in China are Wuhan Iron And Steel Corp and Baoshan iron and steel plant, etc., all of which are produced by plate mill or hot strip mill, and production of thin gauge is difficult, the production cost is high, the shape of the plate is difficult to guarantee, the production cycle is long, and the delivery time is difficult to guarantee.

SUMMARY

An object of the present application is to provide a thin gauge wear-resistant steel sheet and a method for manufacturing thereof, in order to use a smaller amount of alloy to obtain a better and finer microstructure, and to have high wear resistance, weldability and corrosion resistance, and achieve to mass-production of thin gauge wear-resistant steel with good shape, and to reduce production cost and shorten the delivery time.

The present application is completed by providing a thin gauge wear-resistant steel sheet, including the following chemical elements expressed in percentage by weight: 0.15-0.20 wt. % of carbon; 1.2-1.8 wt. % of manganese; 0.1-0.40 wt. % of copper; 0.15-0.30 wt. % of molybdenum; 0.20-0.40 wt. % of chromium; 0.03-0.06 wt. % of niobium; 0.01-0.03 wt. % of titanium; 0.0006-0.0015 wt. % boron; less than 0.015 wt. % of phosphorus; less than 0.010 wt. % of sulphur; and with a balance being ferrum and unavoidable impurities, the thickness of the steel sheet is in a range of 3.0 to 8 mm.

Further, a surface Brinell hardness of the steel sheet is greater than or equal to 370 HBW; and/or a tensile strength of the steel sheet is greater than or equal to 1200 MPa, and a broken extension rate $A_{50}$ of the steel sheet is greater than or equal to 10%.

Another object of the present application is to provide a method of manufacturing a thin gauge wear-resistant steel sheet mentioned above, including steps of:

S1, performing hot metal desulfurization and converter smelting and controlling the content of sulphur in the hot metal to be not less than or equal to 0.0030%, and a thickness of a slag layer to be not less than or equal to 50 mm in the hot metal;

S2, performing converter tapping, and performing deoxidation and alloying using a ferrosilicon or silicon manganese alloy;

S3, performing deoxidation and alloying by RH furnace refining;

S4, performing ladle furnace, adding an aluminum wire and adding an titanium wire or a titanium alloy before exiting for microallying of boron;

S5, performing continuous casting and using a long nozzle protective casting with argon seal, with a superheat degree being controlled between 15-30° C., to obtain a continuous casting slab with a thickness in a range of 55-70 mm;

S6, heating the continuous casting slab in a heating furnace to remove phosphorus at a high-pressure, wherein a temperature of the continuous casting slab entering the heating furnace is greater than or equal to 850° C., the heating time is controlled greater than or equal to 60 min, a heating temperature is in a range of 1050-1150° C., and a temperature of exiting the heating furnace is greater than or equal to 1000° C.;

S7, performing continuous hot rolling and rolling 5-7 times, wherein an outlet temperature of finishing rolling is in a range of 860 to 920° C., and an outlet thickness is in a range of 3.0-8.0 mm; and S8, performing quenching treatment to the steel sheet after rolling, and controlling a cooling rate being in a range of 40-120° C./s, wherein a termination temperature of quenching is in a range of 300-400° C.; and maintaining the temperature for 6 to 10 hours.

Further, in the step S1, the hot metal with a temperature more than 1250° C. and the content of sulphur being not less than or equal to 0.020% is subjected to slagging treatment, and the hot metal is desulfurized by blowing a passivated magnesium; wherein the slagging treatment is performed after the blowing is finished.

Further, in the step S1, an argon blowing process is employed, and a final slag alkalinity is controlled in a range of 3.0-4.0.

Further, in the step S5, a tundish covers a carbon-free alkaline tundish slag, and a medium-carbon wear-resistant steel crystallizer is used to protect the slag.

Further, in the step S5, a speed of the continuous casting is controlled in a range of 3.0-3.5 m/min.

Further, in the step S7, a rolling reduction ratio of the first two times is controlled to be more than 50%, and a rolling reduction ratio of final time is not less than or equal to 15%.

Further, a Brinell hardness of the surface of the steel sheet after the completion of the heat preservation is greater than or equal to 370 HBW.

Further, a broken extension rate $A_{50}$ of the steel sheet after the completion of the heat retention is greater than or equal to 10%.

In the present application, the function of each of chemical elements as following:

The content of carbon is controlled to be 0.15-0.20 wt. %. carbon is the most effective strengthening element in steel, and the interstitial solid solution strengthening of carbon atoms is the most important mechanism for quenching martensite strengthening in quenched steel. The fine carbides and cementite obtained by desolvation during low temperature tempering are the most important mechanism for tempering martensite strengthening in quenched and tempered steel. Both the carbon of interstitial solid solution and the carbon which forms cementite will significantly impair the plasticity, toughness, weldability and cold formability of the steel sheet.

The content of silicon is in a range of 0.2-0.4 wt. %. Silicon has strong deoxidation ability and is a commonly used as deoxidizer for steelmaking, therefore, the steel generally contains Si, the proper amount of silicon can significantly slow down the decomposition rate of tempered martensite at low temperature (200° C.) and increase tempering stability, and the carbides precipitated during tempering are less likely to aggregate and are beneficial for crack resistance. The increase of the content of silicon will increase inclusions like ferrum silicate and manganese silicate, the plasticity is lower than that of sulfide, which will reduce the various mechanical properties of steel, and the low melting point silicate will increase the fluidity of slag and molten metal, and affecting the welding quality.

The content of manganese is in a range of 1.2-1.8 wt. %. Manganese exists mainly in a solid solution state in alloy steel. The solid solution manganese will produce a certain solid solution strengthening effect. In low carbon steel, manganese can make the ferrite grain size after $\gamma \rightarrow \alpha$ phase transformation significantly thinner than that of manganese-free steel. Manganese hardly forms carbides in ordinary low-alloy high-strength steels, but it can synthesize manganous sulfide with residual vulcanization in steel. In general, manganous sulfide is an inclusion that is harmful to the performance of steel, but after proper control and modification, it can significantly reduce the damage to steel properties.

The content of copper is in a range of 0.1-0.40 wt. %, and copper mainly plays a role of solid solution strengthening, improving hardenability and improving corrosion resistance in steel. However, the content of copper is too high will affect the weldability of steel.

The content of molybdenum is in a range of 0.15-0.30 wt. %, and molybdenum is soluble in ferrite, austenite and carbide, and is an element which reduces the austenite phase region, which has a solid solution strengthening effect on ferrite and can improve the stability of the carbide, thereby increasing the strength of the steel, in addition, molybdenum has an advantageous effect on improving the ductility, toughness and wear resistance of the steel. Besides, the Mo can improve the hardenability of steel, improve heat resistance, and prevent temper brittleness. However, the content of molybdenum is excessively high will deteriorate the low temperature toughness and weldability of the steel.

The content of chromium is in a range of 0.20-0.40 wt. %, and the addition of chromium to the steel can significantly improve the oxidation resistance of steel and enhance the corrosion resistance of steel. Chromium can form a continuous solid solution with ferrum and form a variety of carbides with carbon, which has a significant effect on the properties of the steel. In addition, chromium is an effective element to improve the hardenability of the steel, but it also increases the temper brittleness tendency of the steel, and will increase the hardenability of the steel and improve the sensitivity of the steel cold cracking.

The content of niobium is in a range of 0.03-0.06 wt. %, and niobium is a strong carbide forming element with strong grain refinement effect, which can significantly increase the austenite recrystallization temperature, expand the rolling process range, and effectively avoid the mixed crystal structure, such that a good obdurability match of the steel can be ensured. Carbonitride particles formed by niobium in steel can effectively inhibit the growth of austenite grains, improve strength and toughness, reduce the content of free carbon and nitrogen in steel, and reduce the strain aging sensitivity of steel.

The content of titanium is in a range of 0.01-0.03 wt. %, and titanium and carbon and nitrogen can be unlimited soluble, mutually. However, since the solid solubility products of titanium carbide and titanium nitride in austenite are far apart, therefore, titanium nitride is mainly formed at high temperature, which can well act to fix nitrogen in steel.

The content of the boron is in a range of 0.01-0.03 wt. %, and boron is used to improve the hardenability of the quenched and tempered steel, which increases as the carbon content in the steel decreases. The combination of boron and nitrogen will cause the above effects to disappear. Therefore, the present application adds a certain amount of titanium to effectively fix nitrogen.

The content of the phosphorus is less than 0.015 wt. %, and the content of sulphur is less than 0.010 wt. %. sulphur and phosphorus are harmful impurity elements in steel, and phosphorus and sulphur contents in the steel should be as small as possible. When the content of sulphur is large, hot brittleness is likely to occur during hot rolling; while the content of sulphur is large, the steel is prone to cold brittleness. In addition, the phosphorus is also prone to segregation.

Through reasonable alloying design, a small amount of copper, molybdenum, chromium, niobium, titanium and boron alloys are used for microalloying, and the microstructure is controlled by ultra-rapid cooling quenching after rolling control, which fully exerts the performance strengthening effect of the alloy and reduce the amount of alloy added and the use of the amount of precious alloy. Which also simplifies the offline quenching and tempering process of traditional wear-resistant steel after hot rolling. Compared with the traditional process, this production method reduces energy consumption and shortens the process flow. And the time from the steel smelting to product delivery time can be shortened within 24 hours. After the direct ultra-rapid cooling after rolling, the hardenability of the steel sheet is increased by 1.4~1.5 times compared with the traditional reheating quenching process, the toughness ratio of the steel is improved, and the wear resistance, welding performance and corrosion resistance are high. Thin gauge wear-resistant steel with good shape can be volume produced, the product performance is uniform and stable, the social resources is saved and the production costs is deceased.

DETAILED DESCRIPTION

In order to make the purpose, the technical solution and the advantages of the present application be clearer and more understandable, the present application will be further described in detail below with reference to accompanying embodiments. It should be understood that the specific embodiments described herein are merely intended to illustrate but not to limit the present application.

The thin gauge wear-resistant steel sheet provided in the present application, including the following chemical elements expressed in percentage by weight: 0.15-0.20 wt. % of carbon; 1.2-1.8 wt. % of manganese; 0.1-0.40 wt. % of copper; 0.15-0.30 wt. % of molybdenum; 0.20-0.40 wt. % of chromium; 0.03-0.06 wt. % of niobium; 0.01-0.03 wt. % of titanium; 0.0006-0.0015 wt. % boron; less than 0.015 wt. % of phosphorus; less than 0.010 wt. % of sulphur; and the balance being ferrum and unavoidable impurities, the thickness of the steel sheet is in a range of 3.0 to 8 mm.

Through reasonable alloying design, a small amount of copper, molybdenum, chromium, niobium, titanium and boron alloys are used for microalloying, and the microstructure is controlled by ultra-rapid cooling quenching after rolling control, which fully exerts the performance strengthening effect of the alloy and reduce the amount of alloy added and the use of the amount of precious alloy. Which also simplifies the offline quenching and tempering process of traditional wear-resistant steel after hot rolling. Compared with the traditional process, this production method reduces energy consumption and shortens the process flow. And the time from the steel smelting to product delivery time can be shortened within 24 hours. After the direct ultra-rapid cooling after rolling, the hardenability of the steel sheet is increased by 1.4~1.5 times compared with the traditional reheating quenching process, the toughness ratio of the steel is improved, and the wear resistance, welding performance and corrosion resistance are high. Thin gauge wear-resistant steel with good shape can be volume produced, the product performance is uniform and stable, the social resources is saved and the production costs is deceased.

Further, the surface Brinell hardness of the steel sheet is greater than or equal to 370 HBW. The surface Brinell hardness of the steel sheet is in a range of 370-430 HBW. The tensile strength of the steel sheet is greater than or equal to 1200 MPa, and the broken extension rate $A_{50}$ of the steel sheet is greater than or equal to 10%. The thin gauge wear-resistant steel sheet is the wear-resistant steel NM400. the performance thereof meets the technical requirements of NM400 national standard GB/T24186-2009.

The method for manufacturing the thin gauge wear-resistant steel sheet provided in the present application, including steps of:

S1) obtaining a hot metal by blast furnace and performing the hot metal desulfurization, then steelmaking to the hot metal and scrap steel through converter, and controlling the content of sulphur in a hot metal is not less than or equal to 0.0030%, and a thickness of a slag layer in a hot metal is not less than or equal to 50 mm; so as not to be brought into the converter, causing the sulfur content of sulphur to rise in the oxidizing atmosphere;

S2) performing converter tapping, and performing deoxidation and alloying using a ferrosilicon or silicon manganese alloy;

S3) performing RH furnace refining, and Al material is not used for deoxidation and alloying, when reaches RH, measuring and recording the content of oxygen in the steel using a rapid oxygen probe for deoxidation and alloying;

S4) performing ladle furnace, adding an aluminum wire and adding an titanium wire or a titanium alloy before exiting for microallying of boron;

S5) performing continuous casting and using a long nozzle protective casting with argon seal, with a superheat degree being controlled between 15-30° C., to obtain a continuous casting slab with a thickness in a range of 55-70 mm;

S6) heating the continuous casting slab in a heating furnace to remove phosphorus at a high-pressure, wherein a temperature of the continuous casting slab entering the heating furnace is greater than or equal to 850° C., the heating time is controlled greater than or equal to 60 min, a heating temperature is in a range of 1050-1150° C., and a temperature of exiting the heating furnace is greater than or equal to 1000° C., removing phosphorus using high-pressure water, the pressure for removing the phosphorus is greater than or equal to 16 MPa;

S7) performing continuous hot rolling and rolling 5-7 times, wherein an outlet temperature of finishing rolling is in a range of 860 to 920° C., and an outlet thickness is in a range of 3.0-8.0 mm; and S8) performing quenching treatment to the steel sheet after rolling using ultra-quick cooling device, and the cooling rate is controlled in a range of 40 to 120° C./s, and the quenching termination temperature is in a range of 300-400° C. Here, it is on-line quenching, that is, direct quenching and cooling after splicing, which makes full use of the residual heat generated by the splicing to reduce energy consumption, shorten the process flow, and improve production efficiency. The coiler takes up the steel sheet and sends it to the insulation pit for 6~10 hours, and then leveling, finishing, inspecting, marking, judging and storing in a leveling unit.

Through reasonable alloying design, a small amount of copper, molybdenum, chromium, niobium, titanium and boron alloys are used for microalloying, and the microstructure is controlled by ultra-rapid cooling quenching after rolling control, which fully exerts the performance strengthening effect of the alloy and reduce the amount of alloy added and the use of the amount of precious alloy. Which also simplifies the offline quenching and tempering process of traditional wear-resistant steel after hot rolling. Compared with the traditional process, this production method reduces energy consumption and shortens the process flow. And the time from the steel smelting to product delivery time can be shortened within 24 hours. After the direct ultra-rapid cooling after rolling, the hardenability of the steel sheet is increased by 1.4~1.5 times compared with the traditional reheating quenching process, the toughness ratio of the steel is improved, and the wear resistance, welding performance and corrosion resistance are high. Thin gauge wear-resistant steel with good shape can be volume produced, the product performance is uniform and stable, the social resources is saved and the production costs is deceased.

Further, in the step S1, the hot metal with a temperature more than 1250° C. and the content of sulphur being not less than or equal to 0.020% is subjected to slagging treatment; and according to the temperature and weight of the incoming hot metal and the sulfur content of desulfurization terminus to determine the amount of blowing of passivated magnesium, and the magnesium is desulfurized by spray passivation. After the end of the spraying, the sluggish slag and the sufficient slagging treatment are processed.

Further, in step S1, the steel cannot be smelted in the first 6 furnaces of the converter newly blow-in and the first two furnaces after the large replenishment, and the whole process is performed by an argon blowing process, and a final slag alkalinity is controlled in a range of 3.0-4.0. With pellets as a coolant, pellets and scales must be added in accordance with relevant regulations. Fluorite should be added in small quantities according to the slag in the furnace, the amount of fluorite added is not less than or equal to 4 kg per ton steel, and the amount of fluorite added is not less than or equal to 5.5 kg per ton steel when double slag, the fluorite is forbidden to add prior to 2 min of the completion of the blowing, the slag cone and slag stopper are used to perform a double slag-stopping tapping, the slag layer is not less than or equal to 50 mm, and converter steel tapping with silicon iron or silicon manganese alloy for deoxidation and alloying, according to the target with ferrosilicon.

Further, in step S5, a tundish covers a carbon-free alkaline tundish slag, and a medium-carbon wear-resistant steel crystallizer is used to protect the slag, and the superheat degree is controlled in a range of 15-30° C. The continuous casting process is put into the electromagnetic stirring of the crystallizer, and the continuous casting soft pressing process is adopted in a sector segment, the continuous casting speed is controlled in a range of 3.0-3.5 m/min, and a thickness of the continuous casting slab is in a range of 55-70 mm.

Further, in step S7, a rolling reduction ratio of the first two times is controlled to be more than 50%, and a rolling reduction ratio of final time is not less than or equal to 15% to ensure accurate thickness and good shape.

Further, a Brinell hardness of the surface of the steel sheet after the completion of the heat preservation is greater than or equal to 370 HBW. The steel sheet after the completion of the heat preservation has a surface Brinell hardness of 370-430 HBW. The tensile strength of the steel sheet after the completion of the heat preservation is greater than or equal to 1200 MPa, and the broken extension rate $A_{50}$ is greater than or equal to 10%. The thin gauge wear-resistant steel sheet is the wear-resistant steel NM400. the performance thereof meets the technical requirements of NM400 national standard GB/T24186-2009.

The present application is further described in conjunction with the specific embodiments, which are not intended to limit the scope of the present application.

Example 1

The chemical elements composition of the slab and the content thereof expressed in percentage by weight are respectively: 0.15 wt. % of carbon; 0.25 wt. % silicon; 1.25 wt. % of manganese; 0.12 wt. % of copper; 0.28 wt. % of molybdenum; 0.22 wt. % of chromium; 0.031 wt. % of niobium; 0.011 wt. % of titanium; 0.0007 wt. % boron; 0.010 wt. % of phosphorus; 0.002 wt. % of sulphur; and the balance being ferrum and unavoidable impurities. The manufacture method is as follows: slagging treatment the qualified hot metal with temperature of 1255° C. and the content of sulphur being 0019%; then blowing passivated magnesium to be desulfurized; then performing slagging treatment after the blowing finished, the slagging rate is 92%, the content of sulphur of final hot metal is 0.0010%, the whole process is performed by an argon blowing process, and a final slag alkalinity is 3.5. the pellets and scales are added as coolant; the fluorite is added in small quantities to steel per ton with amount of 3.1 kg, the slag cone and slag stopper are used to perform a double slag-stopping tapping, the slag layer is 48 mm, and converter steel tapping with silicon iron or silicon manganese alloy for deoxidation and alloying. After RH, measuring and recording the content of the oxygen in the steel using a rapid oxygen probe for deoxidation and alloying, aluminum wire and titanium wire are sequentially added before the LF refining exiting, then adjusting the components of aluminum and titanium, finally, performing the microalloying of boron; the continuous casting uses a long nozzle to protect the casting and sealing by Argon, a tundish covers a carbon-free alkaline tundish slag, and a medium-carbon wear-resistant steel crystallizer is used to protect the slag, and the superheat degree is controlled in 16° C.; the continuous casting process is put into the electromagnetic stirring of the crystallizer, and the continuous casting soft pressing process is adopted in a sector segment, the continuous casting speed is controlled in 3.0 m/min, and a thickness of the continuous casting slab is 70 mm; the temperature of the continuous casting slab entering the heating furnace is 855° C., the heating time is 62 min, the heating temperature is 1050° C., the finishing temperature of the slab from the heating furnace is 1010° C., removing phosphorus using high-pressure water, the front part of the pressure for removing the phosphorus is 20 MPa, and the latter part of the pressure for removing the phosphorus is 24 MPa, after phosphorus removal, it enters the hot-rolling 5-stand finishing station, wherein the reduction ratio of the first 2 passes of finishing rolling is 55.2%, 53.4%, the final pass reduction rate is 11.2%, the exit thickness of rolling mill is 8 mm, the finishing temperature is 870° C., and the rolled piece is quenched by an ultra-quick cooling device after being taken out of the rolling mill, the cooling rate is 45° C./s, the quenching termination temperature is 310° C., The coiler takes up the steel sheet and sends it to the insulation pit for 10 hours, finally, the steel sheet is leveled and finished on the leveling unit.

Testing the steel sheet, the yield strength is 1095 MPa, the tensile strength is 1285 MPa, the extension rate $A_{50}$ is 13.5%, the surface Brinell hardness is 402 HBW; and Charpy V-shaped impact energy is respectively 72 J, 65 J and 62 J under condition of −20° C.; the testing performance thereof meets the technical requirements of NM400 national standard GB/T24186-2009.

Example 2

The chemical elements composition of the slab and the content thereof expressed in percentage by weight are respectively: 0.16 wt. % of carbon; 0.38 wt. % silicon; 1.3 wt. % of manganese; 0.22 wt. % of copper; 0.16 wt. % of molybdenum; 0.25 wt. % of chromium; 0.035 wt. % of niobium; 0.015 wt. of titanium; 0.0010 wt. % boron; 0.010 wt. % of phosphorus; 0.002 wt. % of sulphur; and the balance being ferrum and unavoidable impurities. The manufacture method is as follows: slagging treatment the qualified hot metal with temperature of 1280° C. and the content of sulphur being 0015%; then blowing passivated magnesium to be desulfurized; then performing slagging treatment after the blowing finished, the slagging rate is 94%, the content of sulphur of final hot metal is 0.0020%, the whole process is performed by an argon blowing process, and a final slag alkalinity is 3.2. the pellets and scales are added as coolant; the fluorite is added in small quantities to steel per ton with amount of 3.2 kg, the slag cone and slag stopper are used to perform a double slag-stopping tapping, the slag layer is 24 mm, and converter steel tapping with silicon iron or silicon manganese alloy for deoxidation and alloying. After RH, measuring and recording the content of the oxygen in the steel using a rapid oxygen probe for deoxidation and alloying, aluminum wire and titanium wire are sequentially added before the LF refining exiting, then adjusting the components of aluminum and titanium, finally, performing the microalloying of boron; the continuous casting uses a long nozzle to protect the casting and sealing by Argon, a tundish covers a carbon-free alkaline tundish slag, and a medium-carbon wear-resistant steel crystallizer is used to protect the slag, and the superheat degree is controlled in 20° C.; the continuous casting process is put into the electromagnetic stirring of the crystallizer, and the continuous casting soft pressing process is adopted in a sector segment, the continuous casting speed is controlled in 3.2 m/min, and a thickness of the continuous casting slab is 70 mm; the temperature of the continuous casting slab entering the heating furnace is 880° C., the heating time is 80 min, the heating temperature is 1080° C., the finishing temperature of the slab from the heating furnace is 1055° C., removing phosphorus using high-pressure water, the front part of the pressure for removing the phosphorus is 16 MPa, and the latter part of the pressure for removing the phosphorus is 24 MPa, after phosphorus removal, it enters the hot-rolling 7-stand finishing station, wherein the reduction ratio of the first 2 passes of finishing rolling is 55.2%, 53.4%, the final pass reduction rate is 11.2%, the exit thickness of rolling mill is 6 mm, the finishing temperature is 912° C., and the rolled piece is quenched by an ultra-quick cooling device after being taken out of the rolling mill, the cooling rate is 68° C./s, the quenching termination temperature is 350° C., The coiler takes up the steel sheet and sends it to the insulation pit for 8 hours, finally, the steel sheet is leveled and finished on the leveling unit.

Testing the steel sheet, the yield strength is 1135 MPa, the tensile strength is 1280 MPa, the extension rate $A_{50}$ is 12.5%, the surface Brinell hardness is 415 HBW; and Charpy V-shaped impact energy is respectively 65 J, 60 J and 68 J under condition of −20° C.; the testing performance thereof meets the technical requirements of NM400 national standard GB/T24186-2009.

Example 3

The chemical elements composition of the slab and the content thereof expressed in percentage by weight are respectively: 0.18 wt. % of carbon; 0.22 wt. % silicon; 1.75 wt. % of manganese; 0.38 wt. % of copper; 0.16 wt. % of molybdenum; 0.39 wt. % of chromium; 0.05 wt. % of niobium; 0.018 wt. % of titanium; 0.0012 wt. % boron; 0.010 wt. % of phosphorus; 0.002 wt. % of sulphur; and the balance being ferrum and unavoidable impurities. The manufacture method is as follows: slagging treatment the qualified hot metal with temperature of 1255° C. and the content of sulphur being 0019%; then blowing passivated magnesium to be desulfurized; then performing slagging treatment after the blowing finished, the slagging rate is 93%, the content of sulphur of final hot metal is 0.0010%, the whole process is performed by an argon blowing process, and a final slag alkalinity is 3.5. the pellets and scales are added as coolant; the fluorite is added in small quantities to steel per ton with amount of 3.2 kg, the slag cone and slag stopper are used to perform a double slag-stopping tapping, the slag layer is 32 mm, and converter steel tapping with silicon iron or silicon manganese alloy for deoxidation and alloying. After RH, measuring and recording the content of the oxygen in the steel using a rapid oxygen probe for deoxidation and alloying, aluminum wire and titanium wire are sequentially added before the LF refining exiting, then adjusting the components of aluminum and titanium, finally, performing the microalloying of boron; the continuous casting uses a long nozzle to protect the casting and sealing by Argon, a tundish covers a carbon-free alkaline tundish slag, and a medium-carbon wear-resistant steel crystallizer is used to protect the slag, and the superheat degree is controlled in 19° C.; the continuous casting process is put into the electromagnetic stirring of the crystallizer, and the continuous casting soft pressing process is adopted in a sector segment, the continuous casting speed is controlled in 3.5 m/min, and a thickness of the continuous casting slab is 55 mm; the temperature of the continuous casting slab entering the heating furnace is 925° C., the heating time is 65 min, the heating temperature is 1150° C., the finishing temperature of the slab from the heating furnace is 1110° C., removing phosphorus using high-pressure water, the front part of the pressure for removing the phosphorus is 20 MPa, and the latter part of the pressure for removing the phosphorus is 24 MPa, after phosphorus removal, it enters the hot-rolling 5-stand finishing station, wherein the reduction ratio of the first 2 passes of finishing rolling is 54.2%, 52.3%, the final pass reduction rate is 10.8%, the exit thickness of rolling mill is 3 mm, the finishing temperature is 920° C., and the rolled piece is quenched by an ultra-quick cooling device after being taken out of the rolling mill, the cooling rate is 115° C./s, the quenching termination temperature is 400° C., The coiler takes up the steel sheet and sends it to the insulation pit for 6 hours, finally, the steel sheet is leveled and finished on the leveling unit.

Testing the steel sheet, the yield strength is 1115 MPa, the tensile strength is 1305 MPa, the extension rate $A_{50}$ is 10.5%, the surface Brinell hardness is 403 HBW; and Charpy V-shaped impact energy is respectively 86 J, 72 J and 65 J under condition of −20° C.; the testing performance thereof meets the technical requirements of NM400 national standard GB/T24186-2009.

Example 4

The chemical elements composition of the slab and the content thereof expressed in percentage by weight are respectively: 0.20 wt. % of carbon; 0.25 wt. % silicon; 1.25 wt. % of manganese; 0.12 wt. % of copper; 0.28 wt. % of molybdenum; 0.22 wt. % of chromium; 0.031 wt. % of niobium; 0.011 wt. % of titanium; 0.0007 wt. % boron; 0.010 wt. % of phosphorus; 0.002 wt. % of sulphur; and the balance being ferrum and unavoidable impurities. The manufacture method is as follows: slagging treatment the qualified hot metal with temperature of 1305° C. and the content of sulphur being 0012%; then blowing passivated magnesium to be desulfurized; then performing slagging treatment after the blowing finished, the slagging rate is 92%, the content of sulphur of final hot metal is 0.0010%, the whole process is performed by an argon blowing process, and a final slag alkalinity is 3.5. the pellets and scales are added as coolant; the fluorite is added in small quantities to steel per ton with amount of 3.0 kg, the slag cone and slag stopper are used to perform a double slag-stopping tapping, the slag layer is 32 mm, and converter steel tapping with silicon iron or silicon manganese alloy for deoxidation and alloying. After RH, measuring and recording the content of the oxygen in the steel using a rapid oxygen probe for deoxidation and alloying, aluminum wire and titanium wire are sequentially added before the LF refining exiting, then adjusting the components of aluminum and titanium, finally, performing the microalloying of boron; the continuous casting uses a long nozzle to protect the casting and sealing by Argon, a tundish covers a carbon-free alkaline tundish slag, and a medium-carbon wear-resistant steel crystallizer is used to protect the slag, and the superheat degree is controlled in 25° C.; the continuous casting process is put into the electromagnetic stirring of the crystallizer, and the continuous casting soft pressing process is adopted in a sector segment, the continuous casting speed is controlled in 3.0 m/min, and a thickness of the continuous casting slab is 60 mm; the temperature of the continuous casting slab entering the heating furnace is 905° C., the heating time is 80 min, the heating temperature is 1100° C., the finishing temperature of the slab from the heating furnace is 1080° C., removing phosphorus using high-pressure water, the front part of the pressure for removing the phosphorus is 20 MPa, and the latter part of the pressure for removing the phosphorus is 24 MPa, after phosphorus removal, it enters the hot-rolling 7-stand finishing station, wherein the reduction ratio of the first 2 passes of finishing rolling is 55.2%, 53.4%, the final pass reduction rate is 11.2%, the exit thickness of rolling mill is 4 mm, the finishing temperature is 870° C., and the rolled piece is quenched by an ultra-quick cooling device after being taken out of the rolling mill, the cooling rate is 80° C./s, the quenching termination temperature is 360° C., The coiler takes up the steel sheet and sends it to the insulation pit for 8 hours, finally, the steel sheet is leveled and finished on the leveling unit.

Testing the steel sheet, the yield strength is 1115 MPa, the tensile strength is 1325 MPa, the extension rate $A_{50}$ is 11.5%, the surface Brinell hardness is 402 HBW; and Charpy V-shaped impact energy is respectively 58 J, 69 J and 63 J under condition of −20° C.; the testing performance thereof meets the technical requirements of NM400 national standard GB/T24186-2009.

The aforementioned embodiments are only preferred embodiments of the present application, and should not be regarded as being limitation to the present application. Any modification, equivalent replacement, improvement, and so on, which are made within the spirit and the principle of the present application, should be included in the protection scope of the present application.

What is claimed is:

1. A method of manufacturing a steel sheet, comprising steps of:

S1, performing hot metal desulfurization and converter smelting and controlling a content of sulphur in a hot metal to be not less than or equal to 0.0030%, and a thickness of a slag layer to be not less than or equal to 50 mm in the hot metal;

S2, performing converter tapping, and performing deoxidation and alloying using a ferrosilicon or silicon manganese alloy;

S3, performing deoxidation and alloying by RH vacuum degassing refining;

S4, performing ladle furnace refining, adding an aluminum wire and adding a titanium wire or a titanium alloy before exiting for microalloying of boron;

S5, performing continuous casting and using a ladle shroud protective casting with argon seal, with a superheat degree being controlled between 15-30° C., to obtain a continuous casting slab with a thickness in a range of 55-70 mm, wherein a speed of the continuous casting is controlled in a range of 3.0-3.5 m/min;

S6, heating the continuous casting slab in a heating furnace to remove phosphorus at a high-pressure greater than 16 MPa, wherein a temperature of the continuous casting slab entering the heating furnace is greater than or equal to 850° C., the heating time is controlled to be greater than or equal to 60 min, a heating temperature is in a range of 1050-1150° C., and a temperature of exiting the heating furnace is greater than or equal to 1000° C.;

S7, performing continuous hot rolling and rolling 5-7 times, wherein an outlet temperature of finishing rolling is in a range of 860 to 920° C., and an outlet thickness is in a range of 3.0-8.0 mm; and S8, performing quenching treatment to the steel sheet after rolling, and controlling a cooling rate to be in a range of 40−120° C./s, wherein a termination temperature of quenching is in a range of 300-400° C.; and maintaining the termination temperature of quenching for 6 to 10 hours.

2. The method of claim 1, wherein in the step S1, a hot metal with a temperature more than 1250° C. and a content of sulphur being not less than or equal to 0.020% is subjected to slagging treatment, and the hot metal is desulfurized by blowing a passivated magnesium thereto; wherein the slagging treatment is performed after the blowing is finished.

3. The method of claim 1, wherein in the step S1, an Argon blowing process is employed, and a final slag alkalinity is controlled in a range of 3.0-4.0.

4. The method of claim 1, wherein in the step S5, a tundish covers a carbon-free alkaline tundish slag, and a medium-carbon wear-resistant steel crystallizer is used to protect the slag.

5. The method of claim 1, wherein in the step S7, a rolling reduction ratio of the first two times is controlled to be more than 50%, and a rolling reduction ratio of the final time is not less than or equal to 15%.

6. The method of claim 1, wherein a Brinell hardness of the surface of the steel sheet after completion of maintaining the termination temperature of quenching is greater than or equal to 370 HBW.

7. The method of claim 1, wherein a broken extension rate A50 of the steel sheet after completion of maintaining the termination temperature of quenching is greater than or equal to 10%.

* * * * *